US009968210B2

(12) United States Patent
Bonnier et al.

(10) Patent No.: US 9,968,210 B2
(45) Date of Patent: May 15, 2018

(54) COMPOSITE STRUCTURE OF FIXABLE FOOD CONTAINER

(71) Applicants: Ai Su Bonnier, Taipei (TW); Adam Bonnier, Taipei (TW)

(72) Inventors: Ai Su Bonnier, Taipei (TW); Adam Bonnier, Taipei (TW)

( * ) Notice: Subject to any disclaimer, the term of this patent is extended or adjusted under 35 U.S.C. 154(b) by 0 days. days.

(21) Appl. No.: 14/877,672

(22) Filed: Oct. 7, 2015

(65) Prior Publication Data

US 2017/0042354 A1 Feb. 16, 2017

(30) Foreign Application Priority Data

Aug. 14, 2015 (TW) ..... 104213212 U

(51) Int. Cl.
*B65D 25/24* (2006.01)
*A47G 19/10* (2006.01)

(52) U.S. Cl.
CPC ..... *A47G 19/10* (2013.01)

(58) Field of Classification Search
CPC ..... A47G 19/08; A47G 19/10; A47G 23/0208
USPC ..... 220/630, 628
See application file for complete search history.

(56) References Cited

U.S. PATENT DOCUMENTS 648,436 A * 5/1900 Rider ..... B65D 1/06 215/377
3,808,084 A * 4/1974 Doty ..... A47G 23/03 248/346.11
4,573,604 A * 3/1986 Guim ..... B65D 23/001 215/376
7,861,647 B2 * 1/2011 So ..... A47J 43/0727 220/483
2003/0189055 A1 * 10/2003 Thinnes ..... A47G 19/2288 220/630

* cited by examiner

*Primary Examiner* — Andrew T Kirsch
*Assistant Examiner* — Don M Anderson

(57) ABSTRACT

A composite structure of a fixable food container is disclosed. The composite structure comprises a plurality of food containers and a fixing disc. A first connecting portion is formed on the bottom of the food container. The fixing disc is used for fixing on a surface. A second connecting portion is formed on the top of the fixing disc for connecting with the first connecting portion and a hole is formed at the center of the fixing disc. The composite structure of the fixable food container has numerous advantages such as improved non-slip capability, stability, and positioning and has compatibility that allows the fixing disc to connect with different kinds of food containers.

1 Claim, 6 Drawing Sheets

COMPOSITE STRUCTURE OF FIXABLE FOOD CONTAINER

CROSS REFERENCE

This non-provisional application claims priority from Taiwan Patent Application NO. 104213212, filed on Aug. 14, 2015, the content thereof is incorporated by reference herein.

FIELD OF THE INVENTION

The invention relates to a food container, and more particularly to a composite structure of a fixable food container possessing advantages of improved non-slip, non-move, non-flip capability and positioning while retaining compatibility with multiple food containers.

BACKGROUND OF THE INVENTION

Food generally consists of carbohydrates, protein, fat and water. The calories and nutrients required to maintain the basic needs of survival can be obtained by eating food. For health and hygiene and to facilitate access to food, people use all kinds of containers for storing food.

It is easy for most people to use chopsticks, forks, knives and other tools to eat with, but it is not easy for preschool children, animals or the elderly and persons with disabilities. Preschool children or the elderly and persons with disabilities usually can not precisely control the eating tool. When they use cutlery to scoop up food, they may often knock over their food container and spill out the food that is in the food container.

SUMMARY OF THE INVENTION

Accordingly, to solve the above problems, an objective of the present invention is to provide a composite structure of a fixable food container. The composite structure of the fixable food container has numerous advantages such as improved non-slip capability, stability, and positioning while retaining compatibility with multiple food containers. Furthermore a composite structure allows the food container to be used both in a fixable capacity and also as a regular food container.

In order to accomplish the above objectives and more, the present invention features a composite structure of a fixable food container comprising: a plurality of food containers each having a receiving space for holding food, a first connecting portion formed on the bottom of the food container; and a fixing disc for fixing on a surface, a second connecting portion formed on the top of the fixing disc for connecting with the first connecting portion, and a hole formed at the center of the fixing disc.

In an embodiment of the present invention, the composite structure further comprises a support and a channel formed on the inside wall of the hole with the support mounted inside the hole via the supports' outer edge engaged within the channel.

A user can use the fixing disc to fix the food container on a surface to effectively position and prevent the slipping of the food container when eating. It is noted that the fixing disc has the second connecting portion formed on the top of the fixing disc. The second connecting portion fixedly connects with the first connecting portion of the food containers. Therefore, the present invention has compatibility that allows the user to use one fixing disc connected with different kinds of food containers.

It is noted that the support is mounted inside the hole via the supports' outer edge engaged with the channel, increasing the stability of the structure.

DETAILED DESCRIPTION OF THE INVENTION

In order to describe details of preferred embodiments of the present invention, description of the structure, and the application as well as the steps are made with reference to the accompanying drawings. It is learned that after the description, any variation, modification or the like to the structure and the steps of the embodiments of the preferred embodiments of the present invention is easily made available to any person skilled in the art. Thus, the following description is only for illustrative purpose and does not, in any way, try to limit the scope of the present invention.

Figure 1:
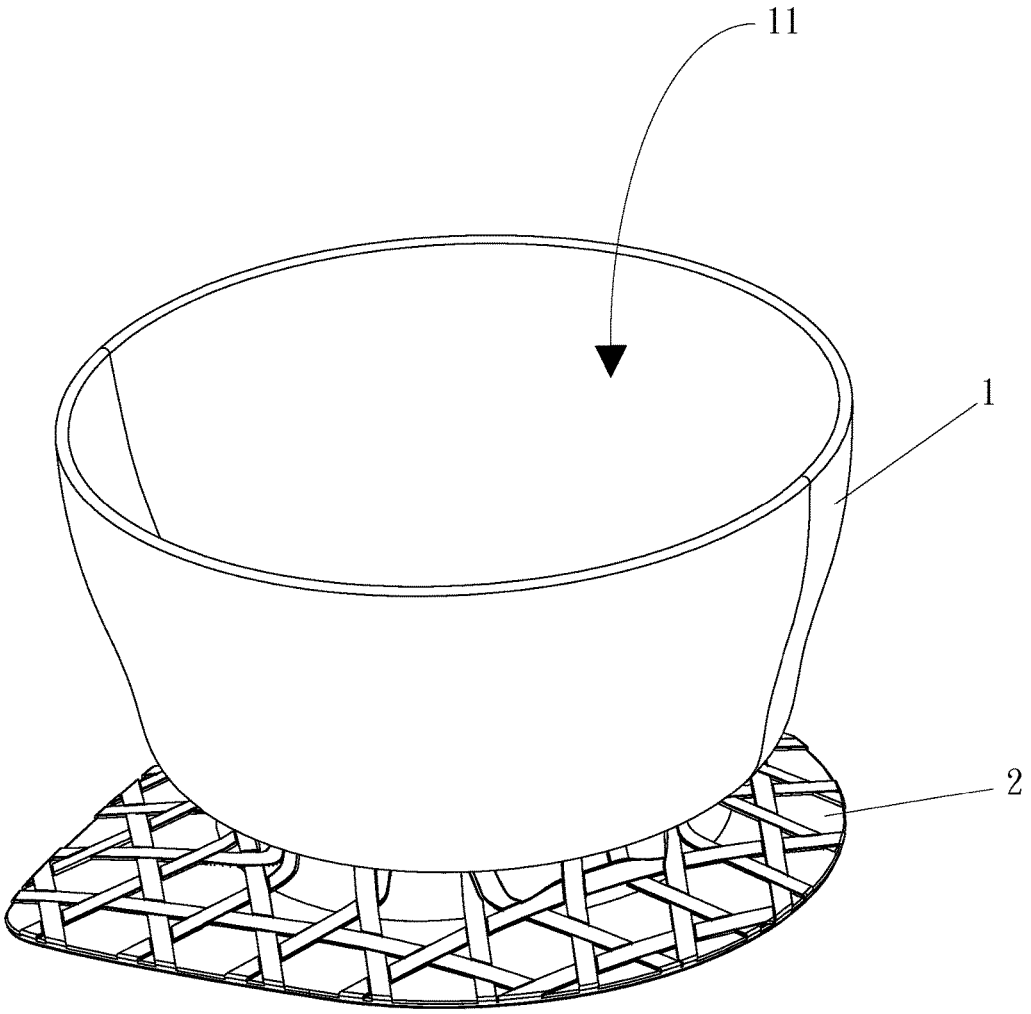
FIG. 1 is a perspective view of a preferred embodiment of the present invention.
Figure 2:
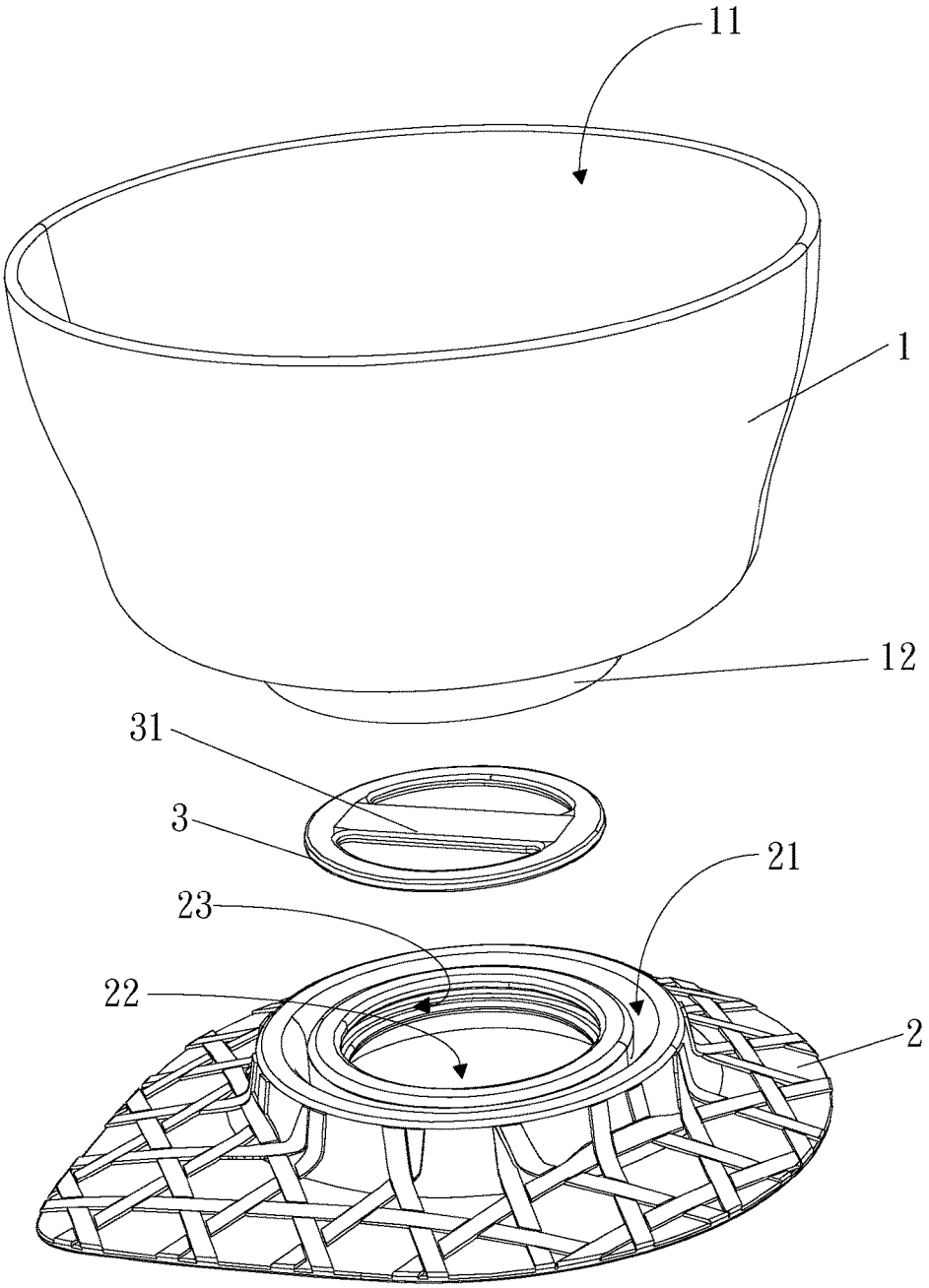
FIG. 2 is a first exploded perspective view of the preferred embodiment of the present invention.
Figure 3:
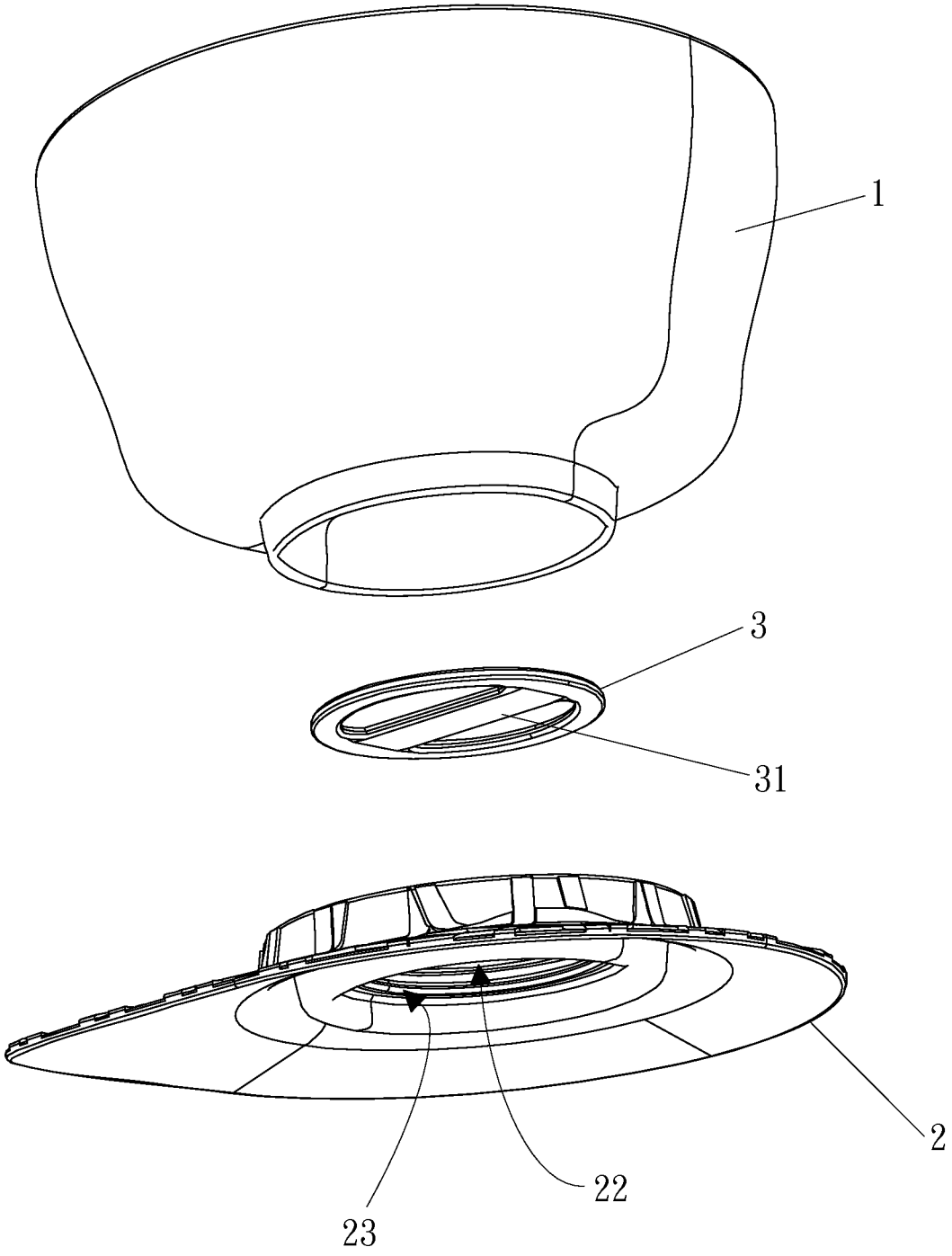
FIG. 3 is a second exploded perspective view of the preferred embodiment of the present invention.

With reference to FIGS. 1, 2 and 3 of a preferred embodiment of the present invention, the composite structure of a non-slip food container is used for positioning a food container and providing non-slip advantages. The present invention has compatibility properties that allow the user to use one fixing disc connected with different kind of food containers 1. The composite structure of the non-slip food container comprises: a plurality of food containers 1, a fixing disc 2 and a support 3.

The plurality of food containers 1 each has a receiving space 11 for containing food, wherein the food container 1 is a bowl, a dish, a cup or any container that has the receiving space 11 that can be used for holding food. A first connecting portion 12 is formed on the bottom of the food container 1. In the preferred embodiment, the first connecting portion 12 is a prominent ring formed on the bottom of the food container 1.

The fixing disc 2 is made of a good elastic material (for example, silicone, rubber, polyvinyl chloride or thermoplastic composites, but not limited thereto). The fixing disc 2 is used for fixing on a surface (for example, a desktop). A second connecting portion 21 is formed on the top of the fixing disc 2 for fixedly connecting with the first connecting portion 12. In the preferred embodiment, the second connecting portion 21 is a groove formed on the top of the fixing disc 2. A hole 22 is formed at the center of the fixing disc 2 and penetrates through the fixing disc 2. A channel 23 is formed on the side of the inner wall of the hole 22. The groove surrounds the channel 23, and the channel 23 is aligned opposite to inner walls of the groove.

The support 3 is mounted inside the hole 22 via the outer edge of the support 3 engaged in the channel 23. The support 3 is made of a hard material (for example, plastic, but not limited thereto). In the preferred embodiment, the support 3 is a ring structure and the support 3 has a connecting rib 31 for increasing strength. Moreover, the support 3 is not a necessary element of the present invention. The support 3 can effectively enhance a grip-like connection strength between the first connecting portion 12 and the second connecting portion 21, increasing the stability and grip-like connection strength of the entire structure by preventing movement of the walls of the groove, aligned, opposite to, and surrounding the channel, when the first connecting portion 12 is connected to the second connecting portion 21. The food container 1 does not contact or rest on support 3.

It is noted that the fixing disc 2 is connected with the food container 1 via the second connecting portion 21 connecting with the first connecting portion 12. The present invention does not limit the first connecting portion 12 to a prominent ring formed on the bottom of the food container 1 and the second connecting portion 21 to a groove formed on the top of the fixing disc 2. The first connecting portion 12 can be a groove formed on the bottom of the food container 1 and the second connecting portion 21 can be a prominent ring formed on the top of the fixing disc 2.

Figure 4:
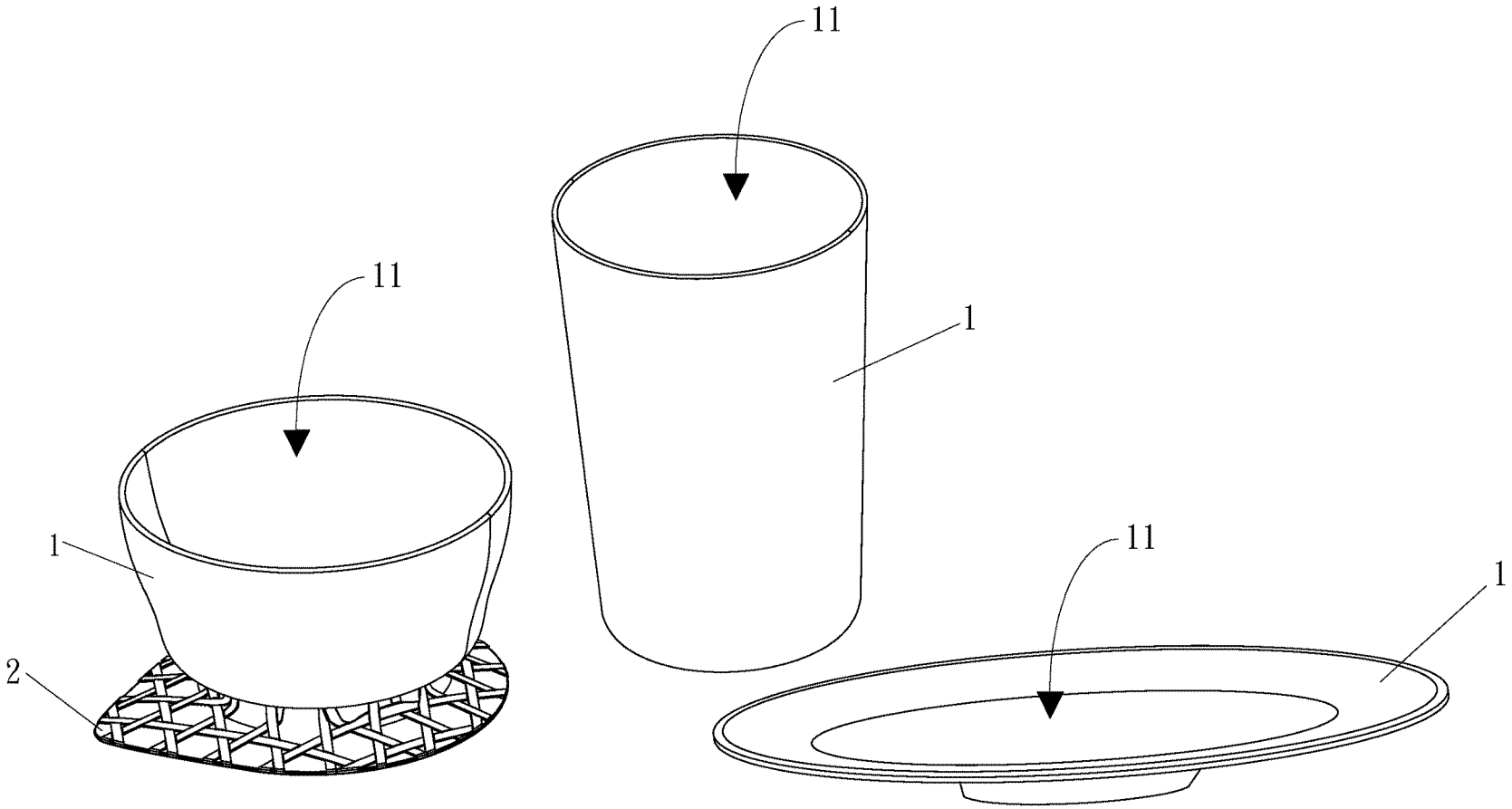
FIG. 4 is a first schematic view of the preferred embodiment of the present invention.

With reference to FIG. 4 of a preferred embodiment of the present invention, a user can use the fixing disc 2 fixed on a surface and use the second connecting portion 21 to connect with the first connecting portion 12 of the food container 1 for effectively positioning and prevent slipping when eating. It is noted that the second connecting portion 21 can fixedly connect with the first connecting portion 12 of the different food containers 1. Therefore, the present invention has the advantage of compatibility that allows the user to use one fixing disc 2 to connect with different kinds of food containers 1.

Figure 5A:
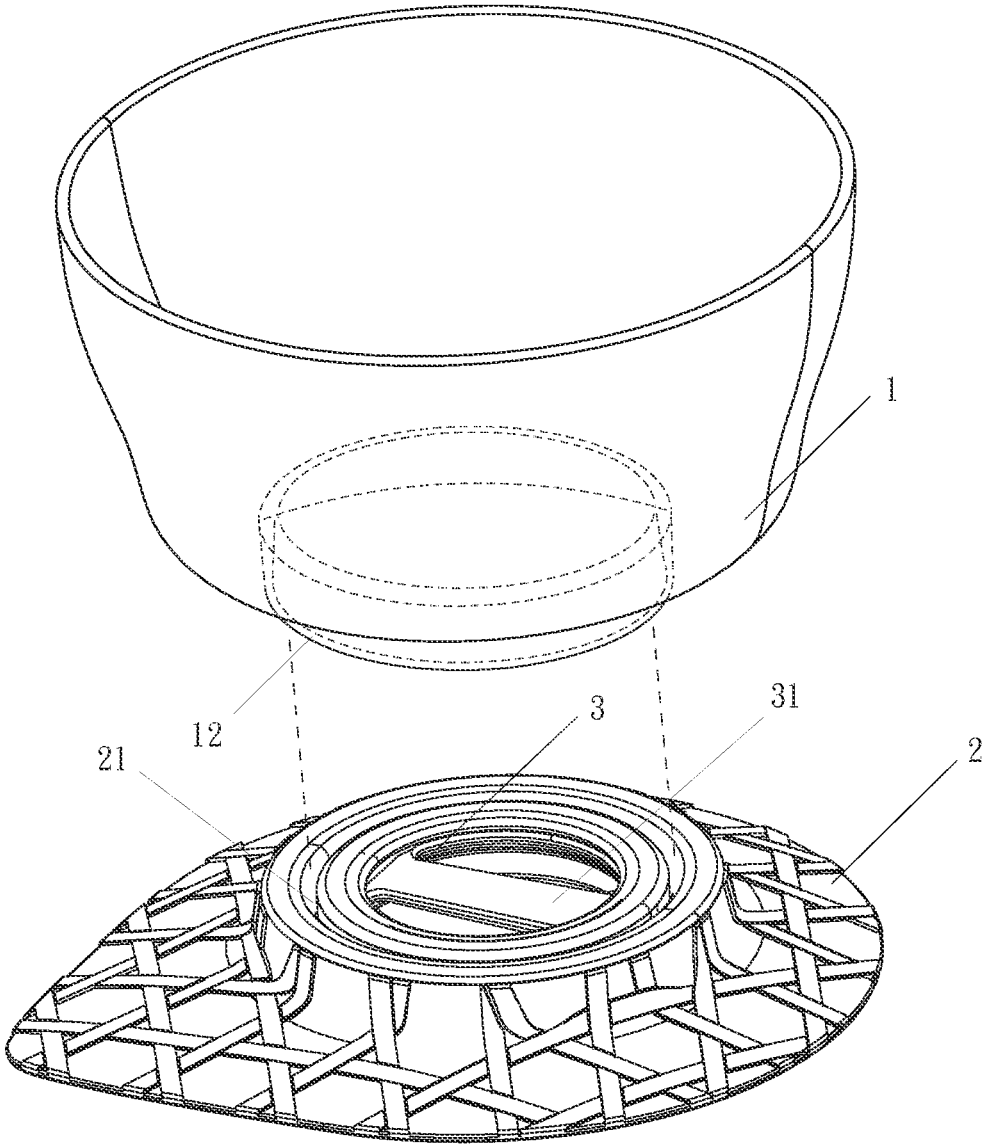
FIG. 5A is a second schematic view of the preferred embodiment of the present invention.
Figure 5B:
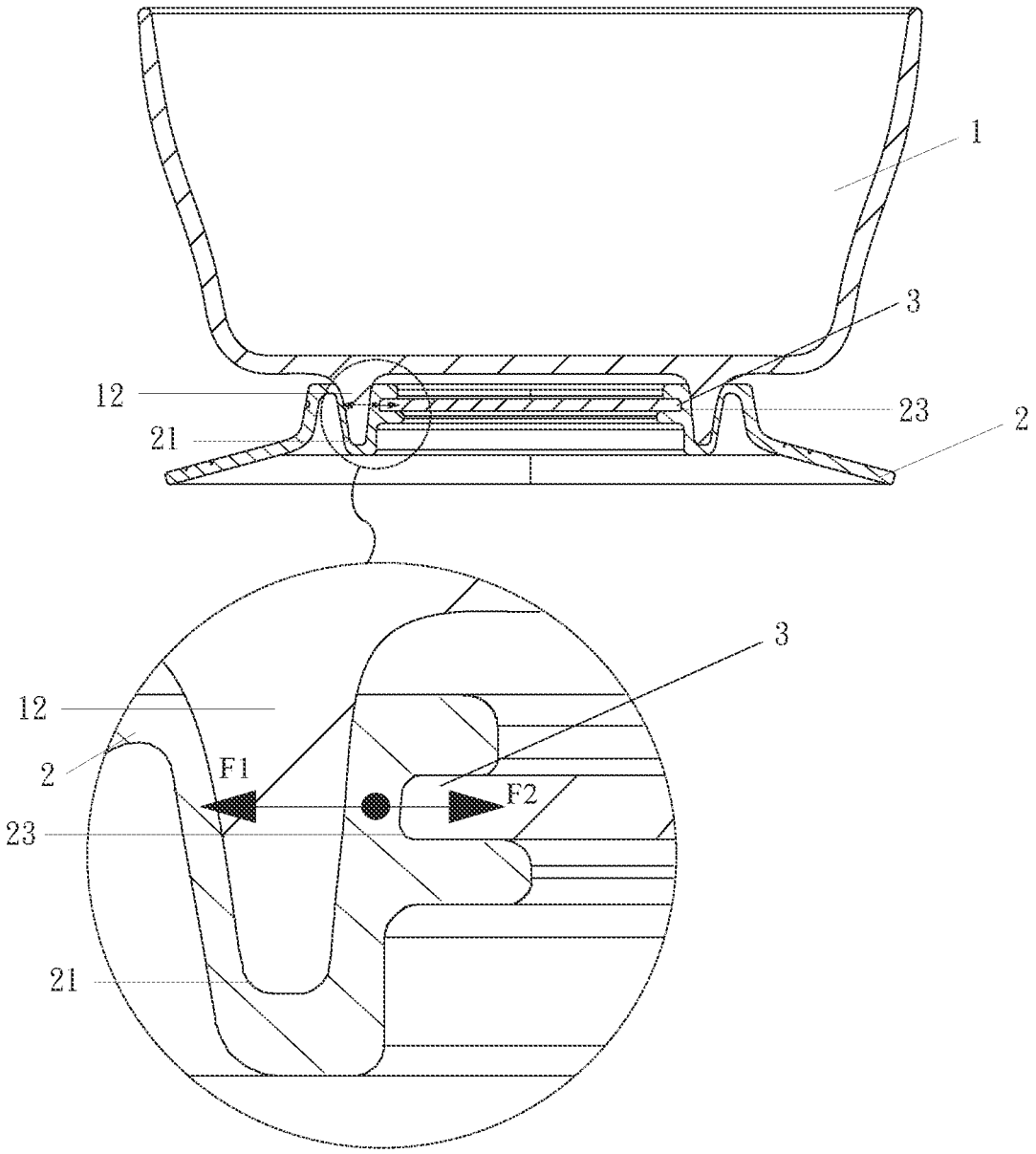
FIG. 5B is a cross-sectional perspective view of the preferred embodiment of FIG. 5A of the present invention.

With reference to FIG. 5A of a preferred embodiment of the present invention and FIG. 5B of a cross-sectional perspective view of the preferred embodiment of FIG. 5A of the present invention, the support 3 is mounted inside the hole 22 via the outer edge of the support 3 engaged in the channel 23. Thus, the support 3 can effectively enhance a grip-like connection strength between the first connecting portion 12 and the second connecting portion 21, increasing the stability and grip-like connection strength of the entire structure by preventing movement of the walls of the groove, aligned, opposite to, and surrounding the channel, when the first connecting portion 12 is connected to the second connecting portion 21. The food container 1 does not contact or rest on support 3.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A structure for a combined fixable food container, which is capable of being used interchangeably with different types of containers, comprising:

a container having a receiving space for holding food, a first connecting portion formed on a bottom of the food container, wherein the first connecting portion is a ring;

a fixing disc for fixing on a surface, a second connecting portion formed on a top of the fixing disc for connecting with the first connecting portion, a hole formed at the center of the fixing disc, and a channel formed on an inside wall of the hole, wherein the fixing disc is made of an elastic material, the second connecting portion is a groove, the groove surrounds the channel, and the channel is aligned opposite to inner walls of the groove; and a support mounted inside the hole via an outer edge of the support engaged within the channel for increasing strength;

wherein the food container does not contact or rest on the support, wherein the strength is a grip-like connection strength between the first connecting portion and the second connecting portion, and the support, engaged within the channel, increase the grip-like connection strength by preventing movement of the walls of the groove, aligned, opposite to, and surrounding the channel, when the first connecting portion is connected to the second connecting portion; and wherein the food container comprises a bowl, dish or cup.

* * * * *